United States Patent [19]

Raulins

[11] Patent Number: 4,685,521

[45] Date of Patent: Aug. 11, 1987

[54] WELL APPARATUS

[76] Inventor: George M. Raulins, P.O. Box 815746, Dallas, Tex. 75381

[21] Appl. No.: 814,397

[22] Filed: Dec. 30, 1985

Related U.S. Application Data

[63] Continuation-in-part of Ser. No. 724,171, Apr. 17, 1985.

[51] Int. Cl.[4] ..... E21B 43/013

[52] U.S. Cl. ..... 166/341; 166/70; 166/344

[58] Field of Search ..... 166/70, 115, 336, 338, 166/341, 343, 344, 348, 360, 361, 363, 364; 205/133 A

[56] References Cited

U.S. PATENT DOCUMENTS

| | | | |
|---|---|---|---|
| 3,155,401 | 11/1964 | Musolt | 166/344 |
| 3,163,222 | 12/1964 | Foster et al. | 166/344 |
| 3,427,048 | 2/1969 | Brown | 166/338 |
| 3,451,475 | 6/1969 | Price | 166/336 |
| 4,126,183 | 11/1978 | Walker | 166/338 |
| 4,252,187 | 2/1981 | Wilson | 166/115 |
| 4,489,780 | 12/1984 | Duhon | 166/70 |
| 4,575,044 | 3/1986 | Gentry | 166/70 |

*Primary Examiner*—Stephen J. Novosad
*Assistant Examiner*—William P. Neuder
*Attorney, Agent, or Firm*—Vaden, Eickenroht, Thompson & Boulware

[57] ABSTRACT

Apparatus is disclosed for use in testing a formation of and/or performing remedial work within a subsea well by means of a pipe string which is lowered through a conductor depending from a drilling vessel at the water surface and releasably connected at its lower end to a blowout preventer stack mounted on the head of the well. The string is landed within the wellhead for depending from the wellhead into the well bore, and a so called subsea test tree connected as part of the pipe string has means therein adapted to open and close the string in response to the supply and exhaust of control fluid from a source at the surface, whereby the well may be controlled upon closing the string and raising of the upper end of the string above the tree and closing of the blowout preventer thereabove. A lubricator valve connected as part of the upper end of the string near its connection to the test tree has rams therein which not only permit the string to be opened and closed, but also enable the annular space about a line in the bore of the valve to be closed and/or the line to be sheared in the event of emergency conditions.

11 Claims, 6 Drawing Figures

WELL APPARATUS

This application is a continuation-in-part of my co-pending, Ser. No. 724,171, filed Apr. 17, 1985, and entitled "Subsea Test Tree".

This invention relates generally to apparatus for use in testing a formation of and/or performing remedial work within a subsea well by means of a pipe string which is lowered through a conductor depending from a drilling vessel at the water surface and releasably connected at its lower end to a blowout preventer stack, and which is landed upon the head of the well on which the stack is mounted for depending from the wellhead into the well bore. More particular, it relates to improvements in apparatus of this type wherein each of a subsea test tree connected as part of the lower end of the pipe string and a lubricator valve connected as part of the upper end of the pipe string near its releasably connection to the lower end thereof has means to open and close the string in response to the supply and exhaust of such control fluid, whereby well fluid within the string may be controlled during rising and lowering of well tools on the like through the valve and/or upon raising of the upper end of the string from the tree.

During the drilling of a well of this type, a drill string is raised from and lowered into the well bore by means of suitable equipment on the drilling vessel. Upon drilling of the well to the desired depth, and setting of an outer casing which depends from the wellhead, the pipe string is lowered into and packed off within the casing to permit testing of the prospective formation. The weight of the string is supported by means of a hanger which is connected to its lower end for landing on a seat in the bore of the wellhead to dispose the test tree beneath the level of blind rams of the preventer stack. During testing, the closing means of the test tree is held open to permit well fluid to flow therethrough. The well may be closed in for routine reasons by conventional equipment at the surface, in which case it is not necessary to close off the pipe string by the closing means of the test tree.

However, in the event of a storm or other emergency conditions, pipe rams of the preventer stack beneath the blind rams are moved to positions to close off the bore therethrough about the string, and the pipe string is closed by the closing means of the test tree. The upper end of the test string is released and raised from the test tree, the conductor is released and removed from the stack, and the blind rams of the stack are moved into positions closing the bore above the test tree to control the well and permit the vessel to be moved to another location if conditions require. Upon return of normal conditions, the conductor may be reconnected to the stack, the blind rams may be opened, the upper end of the string reconnected to the test tree, and the closing means of the test tree reopened to resume testing. Control fluid for operating the closing means may be supplied to or exhausted from fluid responsive means thereof from a source on the vessel and connected to such closing means by tubes extending along the upper end of the string and having ends adapted to be fluidly connected with the ends of conduits in the test tree leading to and from the operating means for the closing means.

Apparatus of this type also conventionally includes a lubricator valve connected as a part of the upper end of the pipe string near its releasable connection to the test tree. Thus, during testing and/or remedial work, the lubricator valve may be closed and well pressure in the string thereabove bled off to permit wire line tools or the like to be lowered from the surface into the string above the valve. Then, with well pressure contained by a stuffing box of the control equipment at the surface level, the valve may be opened and the tools lowered through the closing means of the test tree and into the well bore therebelow.

Also, in the event well fluid is at very high pressure when an emergency occurs, the lubricator valve may be closed to prevent the well fluid above it from blasting out the lower end of the upper end of the string, as it is removed from the test tree, and thus possibly damaging the vessel or causing a flash explosion at the surface. In the event the tree is at a relatively shallow location—i.e., less than 200 feet below water level—this is not a serious problem, and the closure of the valve is normally of a construction which is urged into tighter sealing engagement by the pressure of well fluid below it. However, when the tree is at a deep location, there may be need for two such valves, one near the tree, and the other near the upper end of the string, so that the upper valve may be used primarily to contain well pressure and the lower to prevent the escape of high pressure well fluid as the string is removed with the tree, as above described. In this latter case, the closure of the lower lubricator valve is arranged to be urged into tighter sealing engagement by the pressure of fluid above it.

In conventional apparatus of this type, the subsea tree as well as the lubricator valve or valves are adapted to be opened and closed by either a ball or flapper. Although it is possible to lower lines such as thin wall pipe through the pipe string to perform remedial work on the well, the balls and flappers are not capable of closing sealingly thereabout. Also, since the cutting ability of flappers is nearly nonexistent, and that of balls limited to wire and thin wall soft pipe, they are ineffective in cutting or sealing about heavier wall threaded pipe required for servicing wells when high pressure and/or rotation is required. In like manner, it may not be possible to lower electrical conductor lines therethrough for perforating or taking bottom hole measurements, or solid lines therethrough for actuating bottom hole devices while being assured of sealing about them should conditions require.

My co-pending application, Ser. No. 724,171, filed Apr. 17, 1985, and entitled "Subsea Test Tree", discloses apparatus of this type in which the subsea test tree is of such construction as to permit remedial work to be performed under circumstances in which a storm or other conditions may be imminent. As in conventional test trees, the subsea test tree comprises a body having a bore therethrough connectible at its lower end to the lower end of the string and means at its upper end releasably connectible to the upper end of the string, whereby the tree may be raised and lowered with the string into and out of a position landed within the bore of the blowout preventer stack beneath the level of blind rams therein. However, as described in my earlier invention, the test tree differs from conventional test trees in that the body thereof includes guideways which extend from its bore, rams which are slidable in the guideway between positions opening the bore of the body, cylinders in the body, pistons reciprocable in the cylinders and connected to the rams for moving them between open and closed positions, and means which is responsive to the supply and exhaust of control fluid from a source at the surface level for causing the pistons to move the rams between opened and closed positions.

More particularly, there are at least two sets of vertically spaced guideways with the rams in the upper set being of such construction as to close an open bore. In the event the operator of the well is not concerned with emergencies, and remedial work is not to be performed through the string, the other set or sets of rams may also be of such construction as to close on an open bore and thus provide redundant means for controlling the well. Alternatively, in the event remedial work is to be performed, following testing and when the well is on production or during the period when a problem occurs, requiring the use of an inner pipe string, the rams of a lower set are of such construction as to close the bore about a line extending therethrough, whether it is a pipe or a wire. Preferably, the rams within a third and lowermost set of guideways are so constructed as to shear a line within the bore, whereby the upper end of the string may be released therefrom and raised from the test tree in the event of an emergency. Thus, remedial operations may be performed through the string even though it may be necessary to shut in the well in the event of a storm or other emergency conditions.

It is, however, preferable that the rams of the above described test tree, or, for that matter, the closing means of a conventional test tree, be closed only in the event of an emergency which requires removal of the upper end of the string, and not for the purpose of permitting the performance of routine periodic remedial operations, such as snubbing in a piece of pipe or closing off about a line or pipe in its bore. This is especially true since the closing means is beneath the releasable connection of the test tree to the upper end of the string so that it cannot be pulled with the upper end of the string to permit its seals or other wear parts to be inspected for repair or replacement.

It is therefore the primary object of this invention to provide well apparatus of this type in which the test tree is available for closing the pipe string in the event of such emergency conditions, but in which the remedial procedures which were to be performed in the improved test tree of my prior application may instead be performed at another location in the pipe string which enables the wear parts thereof to be raised and inspected when desired.

Another object is to provide a lubricator valve of such construction that, when installed in the pipe string near the tree, it permits the performance of such remedial procedures in the same manner that they were to be performed by the above described improved test tree of my prior application, and which, at the same time, enables the wear parts to be raised and inspected, while serving the conventional purposes of prior lubricator valves as well as additional purposes not possible with prior lubricator valves.

These and other objects are accomplished, in accordance with the illustrated embodiment of this invention, by a lubricator valve including a body having a bore therethrough connectible as part of the upper end of the pipe string so as to be raised and lowered therewith, but nevertheless near the releasable connection of the upper end of the string to the test tree so as to be removable therefrom with the upper end of the string. More particularly, the body includes, as in the body of the tree of my copending application, guideways which extend from its bore, rams which are slidable in the guideway between positions opening the bore of the cylinders in the body, pistons reciprocable in the cylinders and connected to the rams for moving them between open and closed positions, and means which is responsive to the supply and exhaust of control fluid from a source at the surface level for causing the pistons to move the rams between opened and closed positions. As was also the case in the test tree of my prior application, there are at least two sets of vertically spaced guideways in the body, with the rams in the upper set being of such construction as to close an open bore. In the event the operator of the well is not concerned with emergencies and remedial work is not to be performed through the string, the other set or sets of rams may also be of such construction as to close on an open bore and thus provide redundant means for controlling the well. One or both sets of these rams may then be opened and closed, as desired, in the performance of the usual and ordinary operations of a lubricator valve in this environment.

However, in the event remedial work is to be performed, during or following testing and when the well is on production or during the period when a problem occurs, requiring the use of an inner pipe string, the rams of a lower set are of such construction as to close the bore about a line extending therethrough, whether it is a pipe or a wire. Preferably, the rams within a third and lowermost set of guideways are so constructed as to shear a line within the bore, whereby the upper end of the string may be released therefrom and raised from the test tree with the upper end of the line in the event of an emergency. Thus, the lower end of the line is free to drop beneath the closing means of the test tree so that the closing means of the tree and the blind rams of preventer stack may be closed. Nevertheless, because of the above described construction of the lubricator valve, and thus its ability to perform not only it usual functions, but also those of the test tree of my prior application, the test tree used as part of the well apparatus of this application may be of more conventional construction in which the closures may be either balls or flappers.

As in the case of the test tree of my prior application, the basic similarity of the lubricator valve of this application to a standard type of blowout preventer may make it possible to obtain at least the rams and pistons, and possibly other operating parts, from suppliers of blowout preventer parts. Also, the body includes continuations of the guideways and cylinders which extend through the outer side of the body, whereby the rams and pistons may be moved into and out of the guideways and cylinders from the outer side of the body, thus facilitating assembly as well as repair of the valve. The outer configuration of the body is thus relatively compact so as to facilitate its fitting within the bore of the conductor, and there are a pair of cylinders in the body which extend parallel to and on opposite sides of each guideway, with rods on the pistons mounted in the cylinders being connected to rods on the rams for moving them between opened and closed positions, whereby the apparatus is also of minimum size in a direction longitudinally of its bore.

As in the case of a conventional test tree, the closing means of a conventional lubricator valve is often moved between opened and closed positions by operating means which requires control fluid at a pressure to provide a force to overcome high forces due to the pressure of well fluid in the string and seals that must hold the differential pressures between well pressure and control fluid pressure. In accordance with additionally novel aspects of the lubricator valve of this application, and as in the test tree of my prior application, the operating means for the closing means is of such construction that forces due to well fluid which must be overcome by control fluid are relatively small, and the seals need not hold the differential pressures between the well bore and control fluid pressure.

In accordance with other novel aspects of the valve, and as in the test tree of my prior application, the pistons are caused to move between their opened and closed position by one or more accumulators within the body for containing a source of fluid under pressure which connects with the cylinders on one side of the pistons to urge the rams toward closed positions, and means in the body connecting with the cylinders on the other side of the piston for supplying or exhausting control fluid from a remote source to or from such other side at a pressure which overcomes accumulator pressure to hold the rams open as long as such pressure is maintained. Thus, the pressure of the source of fluid at the surface level may be so controlled as to normally hold the rams open, but permit them to close when that pressure is exhausted or reduced a sufficient amount. In such an operating system, the only force due to well fluid which must be overcome by the accumulator fluid to close the rams is that acting over the relatively small cross sectional areas of the rods connecting to the rams.

More particularly, walls are removably mounted across the guideways on the outer ends of the rams and across the cylinders on the outer ends of the pistons, with the accumulator fluid connecting with the outer ends of the pistons, and the control fluid connecting with the inner ends of the pistons. More particularly, the rods on the pistons extend through the walls of the cylinders, the rods on the rams extend through the walls of the guideways, and yokes connect the outer ends of the rods to one another for shifting within recesses in the body on the outer ends of the continuations. As a result, and as previously described, the outer side of the body fits easily within the bore of preventer stack, and the rams and pistons may be assembled or replaced merely upon removal of the walls across the guideways and cylinders.

As illustrated, an accumulator chamber is formed in the body of the valve vertically of the rams and pistons, and a pressure divider is disposed thereacross with a charge of pressure fluid being contained on one side of the divider and the accumulator fluid which acts between the pistons being contained on the other side of the divider, with suitable conduits in the body connecting with the other side of the divider and the cylinders on the outer side of the pistons.

In the drawings, wherein like reference characters are used throughout to designate like parts:

Figure 1:
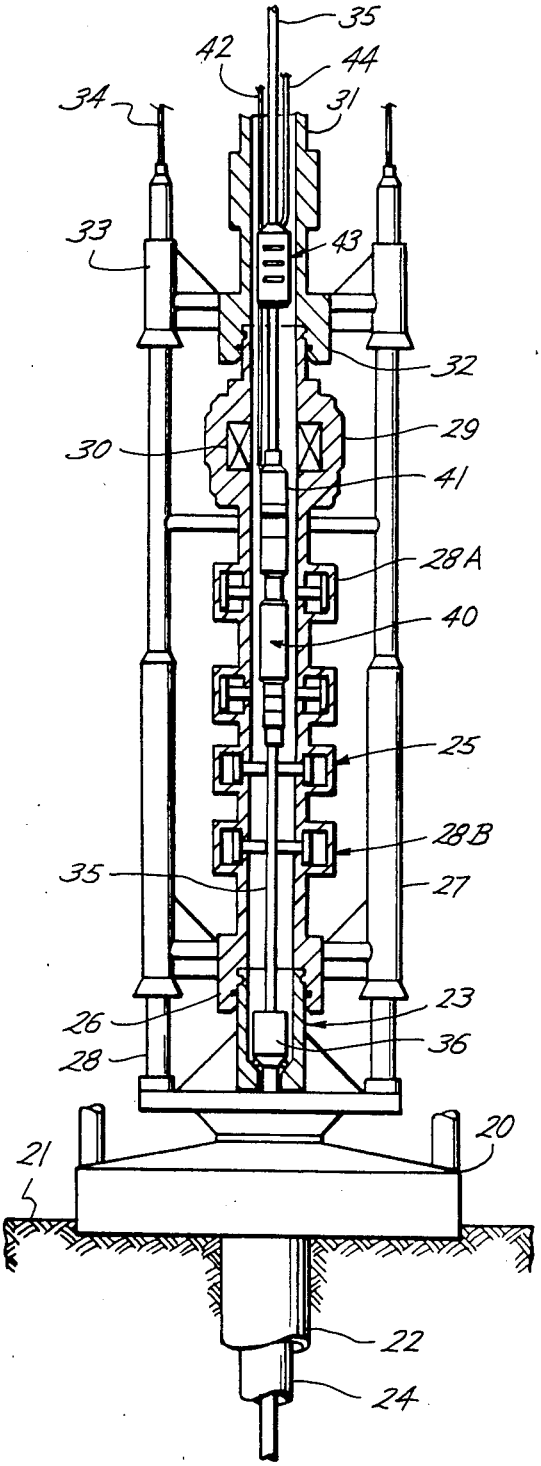
FIG. 1 is a diagrammatic sectional view of a lubricator valve constructed in accordance with the present invention and lowered with a test string into a position in which the test tree is within the bore of the blowout preventer stack and the lubricator in the bore of the riser pipe releasably connected to the upper end of the stack.

With reference now to the details at the above described drawings, the subsea well apparatus shown in FIG. 1 comprises a base 20 on the subsea floor 21 and a conductor casing 22 extending downwardly from the base into the well bore. A wellhead 23 is supported on the base, and an outer casing 24 is suspended from the wellhead 23 and cemented within the outer casing 22. The lower end of the outer casing 24 is adapted to penetrate a formation to be tested. When the formation has been tested and put on production, remedial work may be performed on the well through suitable lines lowered into the well through the outer casing 24.

A blowout preventer stack 25 is mounted above and forms an upper continuation of the bore though the wellhead 23 by means of a releasable connector 26 at its lower end. The stack is adapted to be lowered onto and raised from the wellhead by means of guide members 27 disposed over guide columns 28 extending upwardly from the base 20 to the water surface. The preventer stack 25 includes a plurality of vertically spaced sets of rams mounted within guideways extending from the bore of the preventer stack. The upper most sets of rams 28A may be of the "blind" type adapted to seal against one another to close an open bore. The lower most set of rams 28B, on the other hand, may be formed with recesses on their inner ends for closing about a pipe string therein, as well be described in detail to follow.

The preventer stack 25 also includes an annular type preventer 29 mounted above the upper most pipe rams and having a bore therethrough forming an upper continuation of the bore through the pipe rams. As well known in the art, the annular preventer includes an annular sealing element or packer 30 which is adapted to seal upon itself when the bore is empty or about an object in the bore.

A conductor casing 31 is releasably connected at its lower end to the upper end of the annular preventer by means of a releasable connector 32 and forms an upper continuation of the bore through the preventer stack which extends to pressure control equipment on a drilling vessel at the water surface. The connector on the lower end of the conductor casing is adapted to be lowered onto and raised from the upper end of the preventer stack by means of guide members 33 disposable over the guide columns 27 and adapted to be moved vertically along guidelines 34 extending upwardly from columns 27 to the vessel at the water surface.

As shown in FIG. 1, a test string 35 has been lowered from the water surface into the well bore and extends upwardly through the preventer stack and the conductor casing to the vessel at the water surface. As previously described, the test string includes a tubular hanger 36 connected to an intermediate portion of its lower end and having a shoulder and adapted to land on a seat 37 in the bore of the wellhead member 27 so as to suspend the string within the outer casing 24. A packer carried by the lower end of the test string is adapted to be packed off within the outer casing 24 above the formation to be tested, or the formation which has been tested and brought into production, as the case may be. The hanger is of the "fluted" type so as to permit well fluid to be circulated upwardly between the seat and the shoulder about the lower end of the hanger 36, as may be required during the testing of the formation and/or remedial operations in the well.

The subsea test tree for closing the lower end the test string, and indicated in its entirety by reference character 40, is connected at its upper end to a releasable connector 41 on the lower end of the upper end of the test string. A bundle of tubes 42 extends downwardly along the side of the upper end of the test string for connection with conduits in the releasable connector 41, which in turn are connected with conduits within the test tree leading to means for operating the closing means thereof.

The lubricator valve, which is indicated in its entirety by reference character 43, is connected to the upper end of the string near the connector 41, and thus close to the tree 40. Another bundle of tubes 44 extends downwardly along the side of the upper end of the test string 35 for connection with conduits in the valve 43 leading to means for operating the closing means of the valve, as will be described.

As previously mentioned, due to the novel construction of the lubricator valve, to be described in detail to follow, the subsea tree 40 may be or more conventional construction, rather than that described in my prior application. As also previously described, at a deep location, there may be another lubricator valve near the upper end of the string, although this invention contemplates that only the lower lubricator valve need be of the novel construction to be described.

Figure 2:
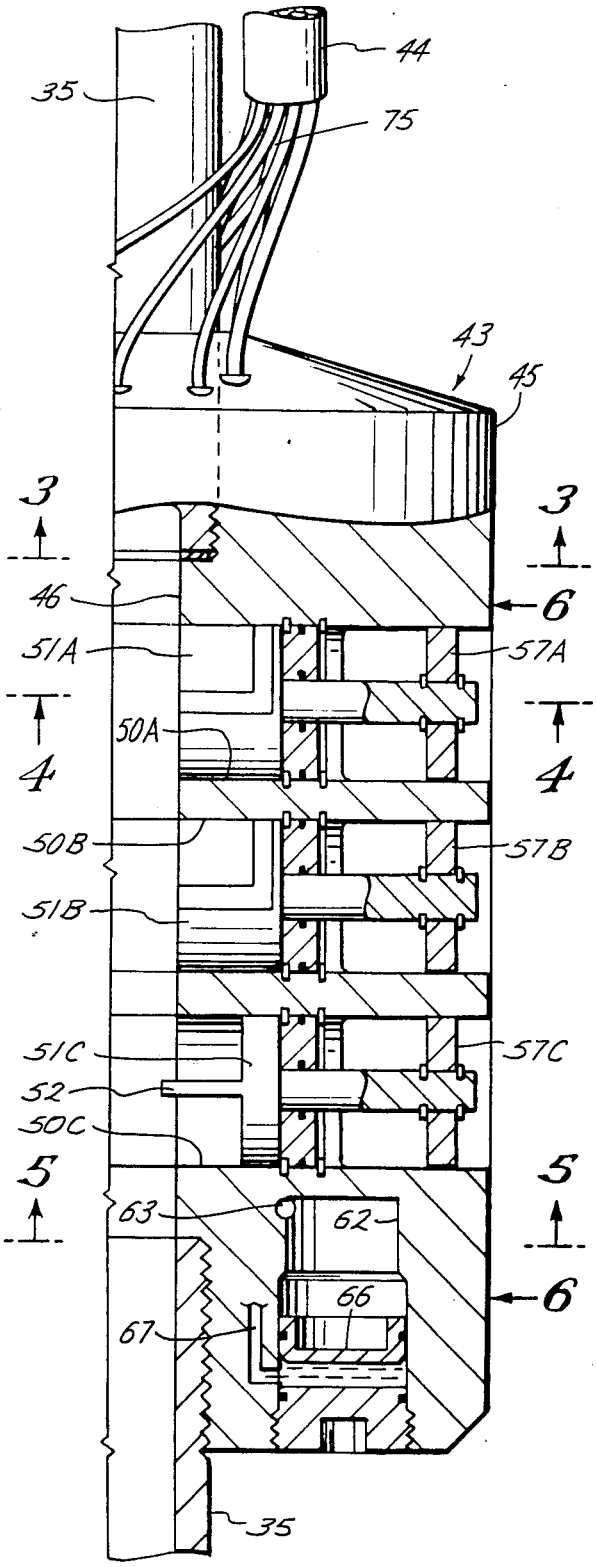
FIG. 2 is an enlarged vertical half sectional view of the lubricator valve, with the rams thereof in open position.
Figure 3:
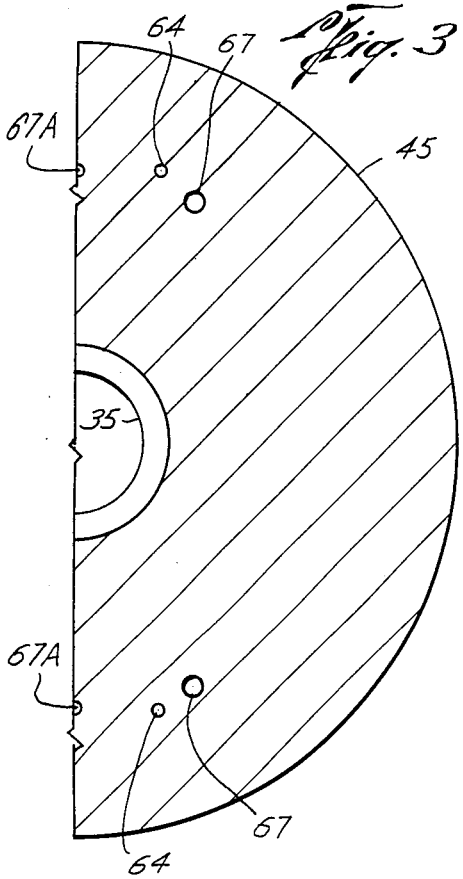
FIG. 3 is a cross sectional view of an upper portion of the lubricator valve, as seen along broken line 3—3 of FIG. 2.

As shown in FIGS. 1 and 2, when the test string is landed in the wellhead 23, the upper end of the test tree 40 is beneath the uppermost set of blind rams 28A of the blowout preventer stack 25, and a "slick joint" in the lower end of the test string 35 is disposed opposite the lower set of pipe rams 28B. As shown in FIG. 1, the upper as well as the next lower set of blind rams of the preventer stack are in open position to accomodate the test string and test tree 40. The pipe rams on the other hand, are moved inwardly to close about the slick joint beneath the closure apparatus 40. As will be understood when the bore of the preventer stack is open—i.e., the test string 35 is not disposed therein—the lower set of blind rams may be closed to provide a redundant means of closing the open bore in the event this is required to control the well.

If a storm or other emergency condition is imminent, such that it is necessary to remove the upper end of the test string 35 from within the well and remove the conductor casing 31 from the upper end of the preventer stack 25 to permit the vessel to be moved, connector 41 is released from the test tree 40 and the blind rams 28A of the blowout preventer stack are moved to closed position so as to close the well bore above the test tree. The lower sets of pipe rams remain closed about the slick joint of the lower end of the pipe string beneath the test tree 40, and the test tree is closed so as to fully control the well both within and without the test tree. In the event remedial work was being performed in the well by means of a line extending through the test string, and in a manner to be described to follow, rams of the lubricator valve have been operated for shearing the line, so that it may fall beneath the closing means of the test tree 40, and closing off the lower end of the string.

As shown in FIG. 2, the lubricator valve 43 includes a generally cylindrical body 45 having an outer diameter which is adapted to fit within the bore of the conductor casing 31 and a bore 46 therethrough which is adapted to form an upper continuation of the upper bore through the test tree and lower continuation of the upper end of the test string 35 thereabove. More particularly, the upper end of the bore is threaded for connection with the upper section of the test string leading to the surface, and the lower end of the bore is threaded to receive the upper threaded end of a joint of pipe connected to the upper end of the releasably connector 41.

As shown in FIG. 2, three sets of vertically spaced guideways 50A, 50B, and 50C extend radially outwardly from the bore 46 of the body 45 on opposite sides thereof. As also shown in FIG. 2, rams 51A, 51B, and 51C are guidably moveable within the guideways 50A, 50B, and 50C, respectively, between outer positions in which they are removed from the bore 46 of the body 45, as shown in FIG. 2 and inner positions in which they are disposed across the bore, as shown by the upper rams 51A in FIG. 4. As will be described in more detail to follow, and as in the case of the rams of the test tree of my copending application, the rams of the valve 43 are of such construction as to permit a line to be run therethrough for the purpose of performing remedial operations. Hence, the upper rams 51A are of the blind type having flat inner ends (see FIG. 4) for engaging one another to close an open bore, the intermediate rams 51B are "pipe" type rams having recesses formed vertically in their inner faces for closing the bore about a line extending therein, and the lowermost rams 51C are provided with blades 52 which have sharp inner edges for shearing a line beneath the pipe rams.

During the testing of the formation of the well, all of the rams of the lubricator valve would, under normal circumstances, be in their open positions. The blind rams 51A may be moved to and from closed positions for the conventional purposes of a lubricator valve, as previously described. Additionally, however, and as previously described, during the performance of remedial work, the blind rams 51A would be open, the shear rams 51C would be moved outwardly to accommodate a line which extends therethrough, and the intermediate pipe rams 51B would be moved inwardly to close the bore about the line, as might be required during the performance of the remedial operation.

For example, the rams of the lubricator valve may be moved inwardly to seal off about a conductor line used in perforating a well under conditions in which the hydrostatic head of fluid in the well bore is less than that of the formation fluid, such that the well might tend to flow immediately after perforating. It may also seal off about a small diameter, flexible tubing lowered into the well to permit it to be "unloaded" following perforation, or during snubbing" operations—i.e., to seal about a workover pipe as wireline tools are lowered into the well. However, in the event of a storm or other emergency condition in which it is necessary to remove the upper end of the test string from the test tree 40 quickly, the shear rams 51C would be moved inwardly to shear the line and thus permit the line to drop below the closing means of the tree 40 so that it may be closed and the connector 41 released to permit valve 43 and the upper end of the line within it to be raised. If desired, and, for example, when well pressure in the string is very high, the blind rams of the valve may be closed to contain such fluid above the valve.

In certain cases where remedial work is not anticipated, or where small diameter tubing is not to be used during testing, all rams may be of the blind type, the lower sets of rams providing redundant protection for controlling the well. It's also possible that the remedial work may be performed by a thin flexible line on which blind rams could close, in which case the intermediate pipe rams may not be required and could instead comprise a redundant set of blind rams. It's also contemplated that the operator of the well would not anticipate emergency conditions, and would therefore not use a set of shear rams. In this case, the upper sets of rams could be blind rams, and the lower set pipe rams for closing about the line extending through the bore of valve 43 for remedial purposes. It will also be understood, that the connector 41 may be released and the valve 43 may be pulled upwardly from the well bore, along with the upper end of the test string, to permit one or more sets of rams to be changed from one type to another, depending upon the operations to be performed within the well.

Each of the blind and pipe rams is of conventional construction in that it comprises a body adapted to fit closely within its guideway, and packing which extends across the face of the body for engaging the face packing of the body of the opposing ram, along the sides of the body rearwardly from the ends of the face packing, and laterally across the ram body to connect the outer ends of the side packing. The lateral packing remains in the guideway when the ram is closed so that, as well known in the art, high pressure on one side of the closed rams provides a force urging them closed. Ordinarily, the lateral packing extends across the top of the rams so that the rams are urged into tight sealing engagement by well pressure beneath them. Although this is true of the blind rams when the lubricator valve is installed at a relatively shallow depth, and there is no other lubricator valve in the string above it, the blind rams may be inverted when the valve is the lower of two valves, whereby they are urged into tight sealing engagement by pressure in the string above them. As will be understood from the description to follow, the construction of the rams permits them to be installed in either condition i.e., with their lateral packing on top or bottom. If the valve includes two or more sets of blind rams, they may be so arranged that at least one set is urged into tight sealing engagement by predominant pressure from each direction.

Figure 4:
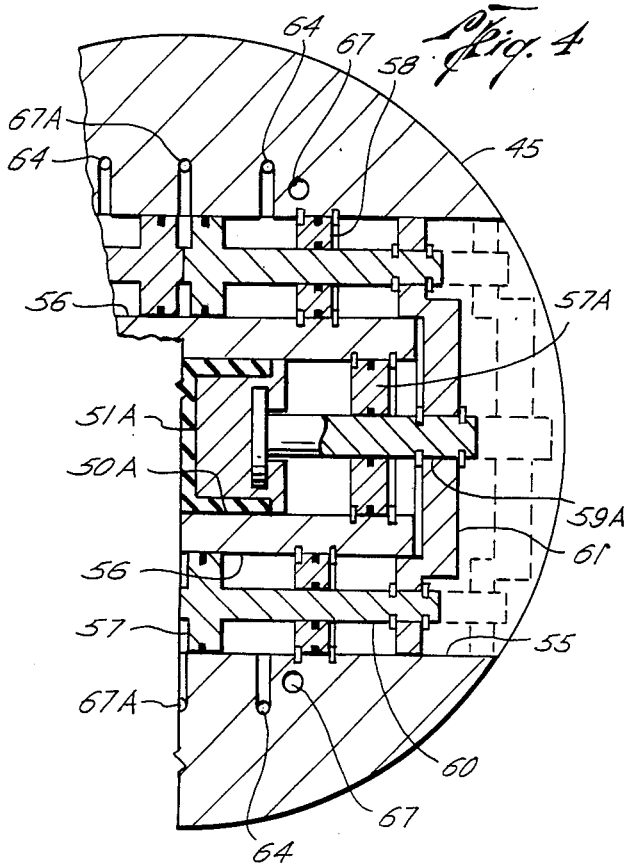
FIG. 4 is a partial cross sectional view of the lubricator valve, as seen along broken line 4—4 of FIG. 2, showing the cylinders and pistons on opposite sides of the guideways and the blind rams, and with the blind rams in shown solid lines in their closed positions.

As shown in FIG. 2, and as illustrated in FIG. 4 in connection with the upper set of blind rams 51A, the guideways for each set of rams have outer continuations which connect with the outer side of the body 45. More particularly, and as can be seen from FIG. 4, the outer continuations of the guideways connect with the central part of an ablong recess 55 formed in each opposite side of the body 45. As indicated in FIG. 4, cylinders 56 are formed in the body 55 on opposite sides of and on generally the same horizontal level as the ram guideways, and also have outer continuations which connect with the recess 55. More particularly, a piston 57 sealably slideable within each cylinder 56 for reciprocation along a path parallel to the path of reciprocation of the rams within their guideways.

Walls 57A, 57B and 57C are removeably mounted across the ends of the guideways, and the opposite ends of the cylinders are closed by means of walls 58 removeably mounted thereacross. More particularly, rods 59A, 59B, 59C are connected at their inner ends to the rams and sealably slideable through holes in the outer walls across the guide-ways, and in like manner, rods 60 extend from the outer sides of the each of the piston and through holes in the walls 58 across the outer ends of the cylinders. As best shown in FIG. 4, the outer ends of the rods connected to the rams and the rods connected to the cylinders are connected to one another by means of yokes 61, and, in these respects the overall arrangement and construction of the rams and pistons is similar to a blowout preventer marketed by Texas Oil Tools of Houston, Tex. However, in accordance with the present invention, the yokes are disposed within the recesses 55 for reciprocation between an inner position when the pistons are moved inwardly to move the rams to closed position, and an outer position shown in broken lines (FIG. 4) when the pistons are moved outwardly to withdraw the rams from the bore of the body 45.

As shown in FIG. 4, each of the guideway and piston walls is removably mounted and sealed within the guideway or cylinder by means of snap rings. In this way, the snap rings may be released and the walls moved outwardly through the continuations of the guideways and cylinders so as to permit the rams and pistons to be moved through the continuations of the guideways and cylinders for purposes of assembly and replacement.

Figure 5:
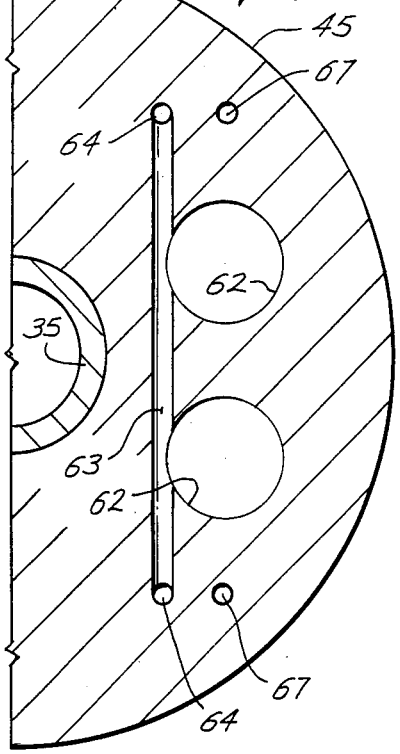
FIG. 5 is still another cross sectional view of the valve, as seen along broken lines 5—5 of FIG. 2.
Figure 6:
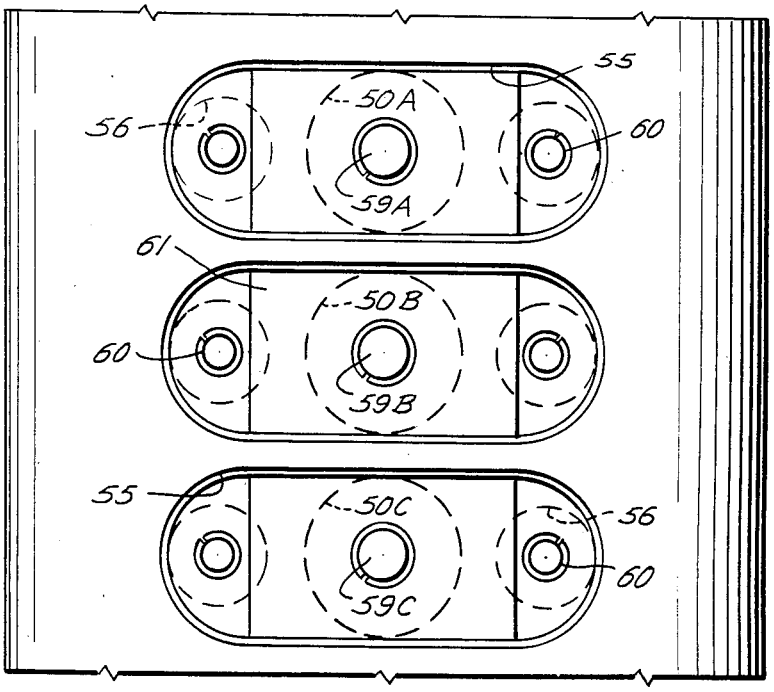
FIG. 6 is a developed view of one outer side of the body of the lubricator, as seen along broken lines 6—6 of FIG. 2.

The pistons 57 are urged inwardly toward one another, and thus the rams to which they are connected are urged toward closed positions, by air or other gas accumulated within chamber of 62 formed within the body beneath the lower set of rams. As shown in FIG. 5, two such chambers are connected to one another by a laterally extending conduit 63 which in turn is connected to the cylinders on the outer sides of the pistons by means of conduit 64 extending upwardly from the lateral conduit 63 and connecting with lateral conduits 65 leading to the cylinders on the outer sides of the pistons. Thus, the accumulator pressure urges the pistons inwardly to urge the blind rams 51A to the closed positions shown in FIG. 4. If desired, the same accumulator 62 may also connect with the cylinders on the outer sides of the pistons connecting with all sets of rams. Alternatively, one or more sets of rams may be urged inwardly by different accumulators.

As shown, each accumulator chamber 62 has a piston 66 sealably slideable in its lower end to divide it into an upper portion in which the accumulator gas is contained and a lower portion into which a charge of pressure fluid is introduced to maintain the accumulator pressure at a desired level. As shown in FIG. 2, a conduit 67 extending vertically downwardly through the valve body 45 connects at its lower end with the chamber beneath the piston 66 so as to permit a suitable charge to be supplied thereto from a source at surface level through tube of bundle 44 connecting with the conduit.

The pistons are adapted to be moved outwardly so as to in turn move the rams to which they are connected to open positions by means of a source of pressure fluid supplied from the surface to the cylinders intermediate the pistons. This control fluid is admitted to the cylinders through a lateral conduit connecting with a vertical conduit 67A which, as will be described to follow, extends through the body for connection with a tube of the tube bundle 44. As will be appreciated, this control pressure must be supplied at a pressure sufficient to overcome the accumulator pressure in order to maintain the rams to which the pistons are connected in open position.

Accumulator pressure, and thus control pressure, may be relatively small due to the relatively small force necessary to urge the rams inwardly toward closed position. Thus, as previously described, the only force due to well pressure which need be overcome by the accumulator pressure is that which acts over the cross sectional areas of the rods 59A, 59B, and 59C connecting the rams to the yokes. As previously described, the control pressure may be exhausted to permit the pistons to move inwardly toward one another and thus cause the rams to move to closed positions. Also, the seals of the pistons 66 need not contain differential pressure between the well fluid and control fluid, but rather the small differential between control fluid and accumulator fluid necessary to move the pistons.

The tube bundle includes five tubes 75, shown in FIG. 2, three of which extend downwardly from the source of control fluid at the surface level for operating the three sets of rams, a fourth from a source of charging fluid for the accumulator, and a fifth for other purposes. Each of the three tubes is connected at its lower end to a separate conduit extending vertically downwardly through the body for connection at its lower end with conduit 67A (FIG. 7) leading to the space between pistons 57, and a fourth tube connects with a conduit 67 leading to the lower side of accumulator piston 66.

The inner edges of the shear rams 52 are preferably skewed with respect to one another so as to move a pipe or other line within the bore of the body 45 into axial positiion within the bore 46 as the shear rams are caused to move to closed position. That is, each such inner edge forms a slight angle with respect to a place perpendicular to the axis of movement of the shear rams, whereby the opposite side edges of the blades will overlap one another to form a decreasing opening between them as the shear rams are moved to closed position.

In summary, and as compared with conventional lubricator valves, the valve 43 makes it possible to perform the following functions at or near the ocean floor:

(1) Close about, seal off and/or shear a conductor "line" that is used in perforating or logging the well where the hydrostatic head of fluid or the formation is less than formation pressure, thus allowing the well to try to flow immediately after perforating;

(2) Close about, seal off and/or shear a small diameter continuous tubing string used to "unload" a well after perforating, and (3) Close off about, seal off and/or shear workover pipe used in "snubbing" operations.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. For use performing operations within a subsea well by means of a pipe string which is lowered through a conductor depending from pressure control equipment at the water surface and releasably connected at its lower end to a blowout preventer stack, said string having means for landing upon the head of the well on which the stack is mounted for depending therefrom into the well bore, and means for selectively closing the lower end of the string upon release and raising of the upper end of the string thereabove; a lubricator valve including a body having a bore therethrough connectible as a part of the upper end of the string near the lower end thereof, so that it may be raised and lowered within the bore of the stack, guideways in the body extending from the bore therethrough, rams slidable in the guideways between positions opening and closing the bore of the body, cylinders in the body, pistons reciprocable in the cylinders and connected to the rams for moving them between opened and closed positions, and means responsive to the supply and exhaust of control fluid from a source at the surface level for causing the pistons to move the rams between opened and closed positions.

2. Apparatus of the character as defined in claim 1, wherein there are at least two sets of vertically spaced guideways, with the rams in one set of guideways being constructed to close upon an open bore, and the rams in the other set of guideways being constructed to shear a line in the bore.

3. Apparatus of the character as defined in claims 1, wherein there are at least two sets of vertically spaced guideways, with the rams in one set of guideways being constructed to close an open bore, and the rams in the other set of guideways being constructed to close about a line in the bore.

4. Apparatus of the character as defined in claim 3, wherein there is a third set of guideways vertically spaced from the other sets, with the rams in said third set being constructed to shear a line in the bore.

5. Apparatus as defined in any one of claim 1 wherein the means for causing the pistons to move includes means within the body for containing a source of fluid under pressure which connects with the cylinders on one side of the pistons to urge the rams toward closed position, and means in the body connecting with the cylinders on the other side of the pistons for supplying or exhausting the control fluid with respect thereto at a pressure which holds the rams open as long as such pressure is maintained.

6. Apparatus as defined in claim 5, wherein the means within the body comprises chamber means in the body spaced vertically of the rams and pistons and having a pressure divider therein, a charge of pressure fluid being contained on one side of the divider and the fluid source being contained on the other side of the divider, and conduits in the body connecting the other side of the divider with the cylinders on the one side of the pistons.

7. Apparatus as defined in any one of claims 1 to 6, where the cylinders in the body extending parallel to and on opposite sides of the guideways.

8. Apparatus of the character as defined in any one of claims 1 to 6, including continuations of the guideways and cylinders which extend through the outer side of the body and through which the rams and pistons may be moved into and out of the guideways and cylinders.

9. Apparatus as defined in claim 8, including walls removably mounted across the guideways on the outer ends of the rams and across the cylinders on the outer sides of the pistons, the fluid contained within the body being on the outer ends of the pistons, and the control fluid being on the inner ends of the pistons, rods on the pistons extending through the walls of the cylinders, rods on the rams extending through the walls of the guideways, and yokes connecting the outer ends of the rods to one another and shiftable within recesses in the body on the outer ends of the continuations, said walls, upon removal, enabling the rams and pistons to be moved into and out of the guideways and cylinders through the continuations thereof.

10. Apparatus as defined in claim 7, including continuations of the guideways and cylinders which extend through the outer side of the body and through which the rams and pistons may be moved into and out of the guideways and cylinders.

11. Apparatus as defined in claim 10, including walls removably mounted across the guideways on the outer ends of the rams and across the cylinders on the outer sides of the pistons, the fluid contained within the body being on the outer ends of the pistons, and the control fluid being on the inner ends of the pistons, rods on the pistons extending through the walls of the cylinders, rods on the rams extending through the walls on the guideways, and yokes connecting the outer ends of the rods to one another and shiftable within recesses in the body on the outer ends of the continuations, said walls, upon removal, enabling the rams and pistons to be moved into and out of the guideways and cylinders through the continuations thereof.

* * * * *